US005279095A

United States Patent [19]

Müller

[11] Patent Number: 5,279,095

[45] Date of Patent: Jan. 18, 1994

[54] APPARATUS FOR SPREADING OPEN FLAT BAGS

[75] Inventor: Werner Müller, Neuhausen am Rheinfall, Switzerland

[73] Assignee: Sig Schweizerische Industrie-Gesellschaft, Neuhausen am Rheinfall, Switzerland

[21] Appl. No.: 22,408

[22] Filed: Feb. 24, 1993

Related U.S. Application Data

[63] Continuation of Ser. No. 740,728, Aug. 6, 1991, abandoned.

[30] Foreign Application Priority Data

Aug. 22, 1990 [CH] Switzerland ..... 2726/90

[51] Int. Cl.[5] ..... B65B 43/30

[52] U.S. Cl. ..... 53/386.1; 198/626.5; 198/689.1; 53/381.6; 493/313

[58] Field of Search ..... 493/309, 313, 319, 314, 493/315, 318; 198/689.1, 626.5; 53/381.6, 570, 386.1

[56] References Cited

U.S. PATENT DOCUMENTS 2,608,974 9/1952 Ferenci ..... 198/689.1
3,446,121 5/1969 Achelpohl ..... 493/313
3,631,768 1/1972 Breidenbach .
3,850,088 11/1974 Tobey ..... 198/689.1
4,596,544 6/1986 Hull ..... 493/313
4,739,910 4/1988 Westphal ..... 493/313
4,782,939 11/1988 Fields ..... 198/689.1

*Primary Examiner*—Jack Lavinder
*Attorney, Agent, or Firm*—Spencer, Frank & Schneider

[57] ABSTRACT

An apparatus for spreading open flattened bags has a first air-pervious endless belt having a working flight provided with a working face and an opposite, reverse face; and a second air-pervious endless belt having a working flight provided with a working face and an opposite, reverse face. The working flights of the first and second belts are divergent at an acute angle in the bag conveying direction. There is further provided a suction device generating a vacuum for urging a gas to flow across the working flights in a direction from the working face to the reverse face of each working flight, whereby each bag introduced between the working flights adheres, with opposite bag panels, to the working faces of the working flights and is forwarded thereby in the conveying direction, while being gradually spread open.

16 Claims, 3 Drawing Sheets

10
1
2
3
4
5
6
7
12
14
18
18'
26
27
27'
27''
44
48
49
50
A 10
2
6
7
8
11
12
13
14
15
16
17
19
20
21
22
39
40
41
48
49
50
III
IV
V

APPARATUS FOR SPREADING OPEN FLAT BAGS

This application is a continuation of application Ser. No. 07/740,728, filed Aug. 6, 1991, now abandoned.

CROSS REFERENCE TO RELATED APPLICATION

This application claims the priority of Swiss Application No. 2726/90-8 filed Aug. 22, 1990, which is incorporated herein by reference.

BACKGROUND OF THE INVENTION

This invention relates to an apparatus for spreading open flat bags which are open along one edge. The apparatus includes an air-pervious suction belt trained about two end rollers, at least one of which is driven. The suction belt has a flight having one face oriented towards the bags to be conveyed and another, reverse face which is exposed to vacuum.

An apparatus of the above-outlined known type is disclosed in U.S. Pat. No. 3,631,768. The apparatus first folds a sheet to form an upwardly open hose. Sealing shoes and severing knives form upwardly open, individual bags from the hose and the bags are separated from one another as they pass through the suction belt. Thereafter, the bags are grasped by grippers at their longitudinal edges, and the two grippers which grasp a bag are moved towards one another whereby the bag spreads open. Subsequently, the bag is charged with goods and sealed. Such an apparatus needs substantial space and reliably spreads the bag open only when the bag material is relatively stiff.

SUMMARY OF THE INVENTION

It is an object of the invention to provide an improved apparatus of the above-outlined type which reliably spreads open the bags even if the bag material is soft and further, the apparatus is of significantly shorter construction than prior art assemblies.

This object and others to become apparent as the specification progresses, are accomplished by the invention, according to which, briefly stated, the apparatus for spreading open flattened bags has a first air-pervious endless belt having a working flight provided with a working face and an opposite, reverse face; and a second air-pervious endless belt having a working flight provided with a working face and an opposite, reverse face. The working flights of the first and second belts are divergent at an acute angle in the bag conveying direction. There is further provided a suction device generating a vacuum for urging a gas to flow across the working flights in a direction from the working face to the reverse face of each working flight, whereby each bag introduced between the working flights adheres, with opposite bag panels, to the working faces of the working flights and is forwarded thereby in the conveying direction, while being gradually spread open.

DESCRIPTION OF THE PREFERRED EMBODIMENT

Figure 1:
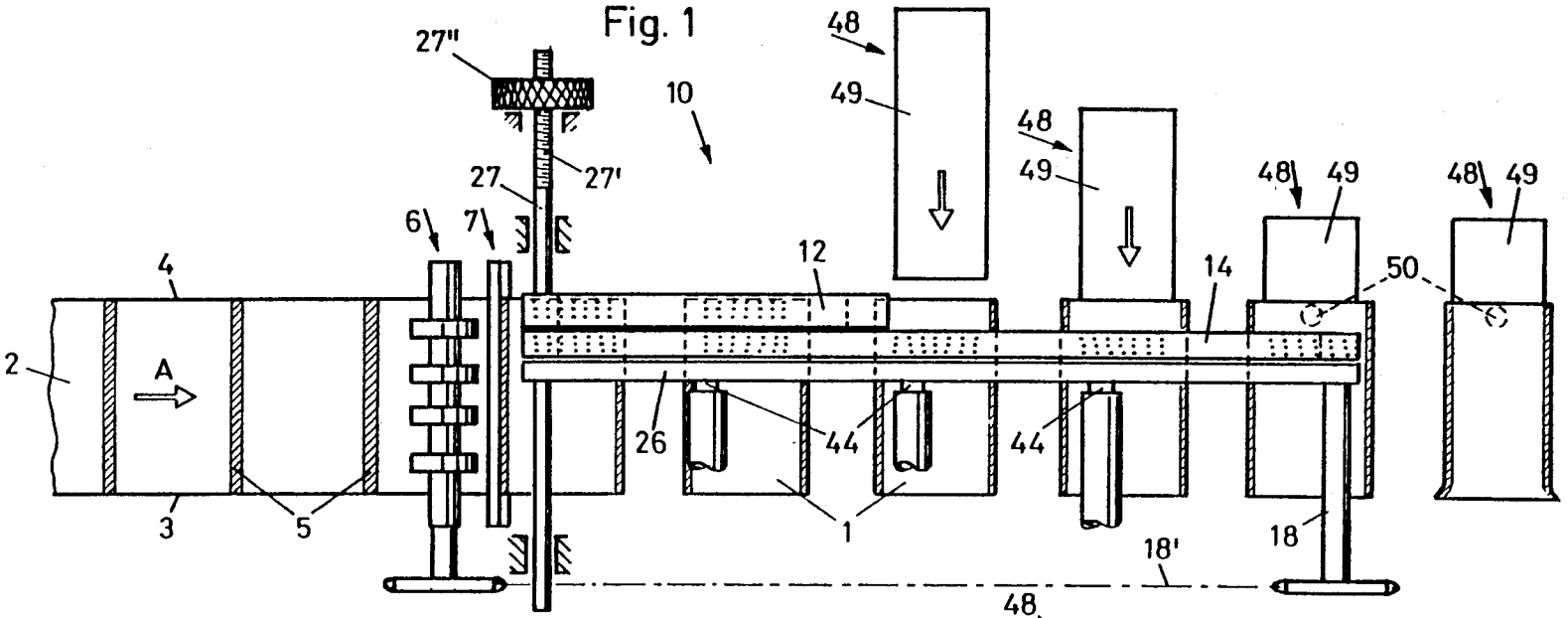
FIG. 1 is a schematic side elevational view of a preferred embodiment of the invention.
Figure 2:
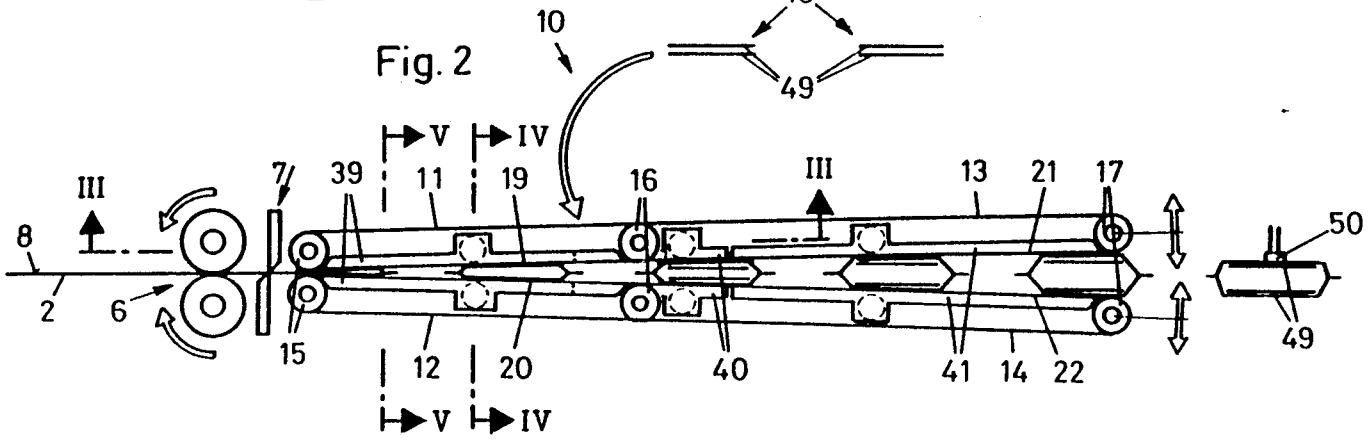
FIG. 2 is a schematic top plan view of the preferred embodiment.

Turning to FIGS. 1 and 2, the apparatus illustrated therein serves for conveying, separating and spreading open upwardly open flat bags 1. A web (sheet) 2 of synthetic material is folded upwardly along a longitudinal center line such that the edge fold 3 is situated at the bottom and the free superposed longitudinal edges 4 are situated at the top. A non-illustrated sealing device provides, transversely to the longitudinal edges 4, sealing seams 5 at uniform distances, to thus bond the two superposed web halves to one another. Thereafter, the sheet 2 is fed to a conveying roller pair 6 which advances the sheet 2 to a cutting device 7 which is synchronized with the roller pair 6 and the sealing device to sever the sheet 2 in each instance along the center line of the seams 5 whereby individual bags 1 are provided.

Downstream of the cutting device 7, as viewed in the conveying direction A, an opening device 10 structured according to the invention is arranged for spreading open the bags as they pass therethrough. The opening device 10 is formed of one pair of upper suction belts 11, 12 and one pair of lower suction belts 13, 14. The suction belts 11–14 are each supported by end rollers 15, 16 and 17. The downstream end rollers 17 of the lower suction belts 13, 14 are driven by a shaft 18 from a drive shown as chain 18′ synchronously with the cycle of the cutting device 7 and the rpm of the conveying roller pair 6. The end rollers 17 are situated significantly farther downstream than the downstream end rollers 16 of the upper suction belts 11, 12. The travelling speed of the suction belts 11–14 is greater than the circumferential speed of the conveying rollers 6, so that the bags 1 are separated from one another as they are grasped by the cooperating suction belts 11–14. The facing flights 19–22 of the two suction belt pairs 11, 12 and 13, 14, respectively, form, with one another, an adjustable acute angle of maximum 5°. The flights 19, 20 and 21, 22 almost touch at their upstream end at the end rollers 15.

The end rollers 15, 16 and 17 of the two superposed suction belts 11, 13 and 12, 14 are each rotatably supported on a common carrier 26. The two carriers 26 are, by means of a rod 27 jointly height-adjustable, for example, by means of a thread 27′ engaging in a nut 27″. The rods 27 are coaxial with the upstream end rollers 15. For setting the spreading angle, the carriers 26 are pivotal about the rods 27. By virtue of these two measures the apparatus 10 may be adapted to different bag configurations. Angle adjustment may e.g. be achieved by a cross shaft 26*a* interconnecting the two carriers 26 and engaging with a right hand and a left hand thread 26*b* respectively in a corresponding pivotable nut 26*c* (FIG. 3).

Figure 3:
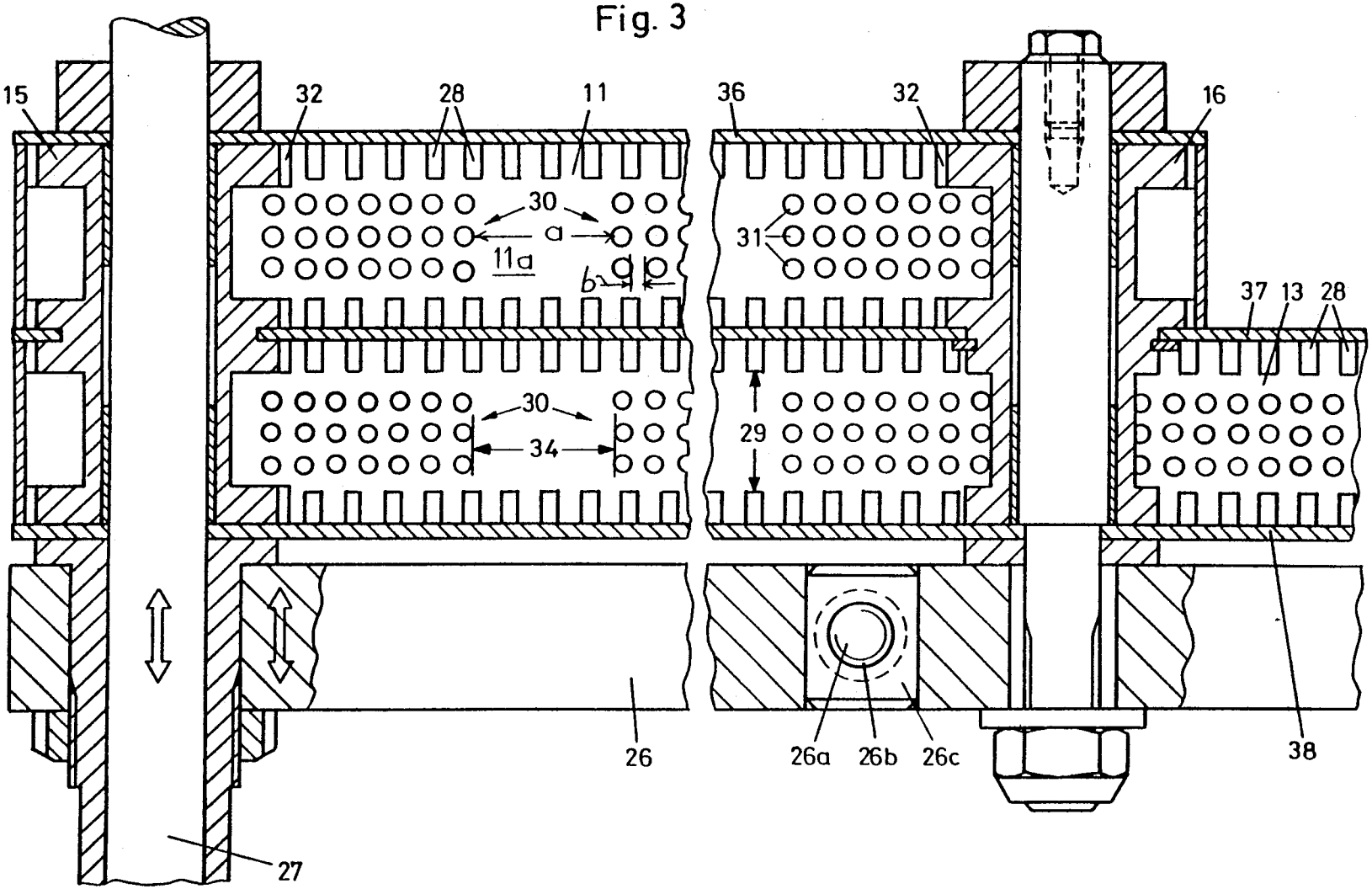
FIG. 3 is an enlarged sectional view taken along line III—III of FIG. 2.

Turning to FIG. 3, the suction belts 11–14 are endless sprocket belts which have teeth 28 on their inner faces (designated at 11*a* for the belt 11) only along opposite longitudinal edge zones. In the flat mid zone 29 which is void of teeth, the belts 11–14 have groups 30 of apertures 31. The groups 30 are uniformly spaced from one another; the spacing between adjoining groups 30 corresponds to the distance between adjoining conveyed bags 1. The spacing a between adjoining groups 30 is greater than the spacing b between adjoining apertures 31 within one and the same aperture group 30 as viewed along the belt length. In the zone 34 between adjoining groups 30 the suction belts 11–14 are aperture-free. The end rollers 15, 16 and 17 are sprockets whose teeth 32 engage into the gaps between the teeth 28 of the belts 11–. The two coaxial upstream end rollers 15 are rigidly coupled to one another.

Figure 5:
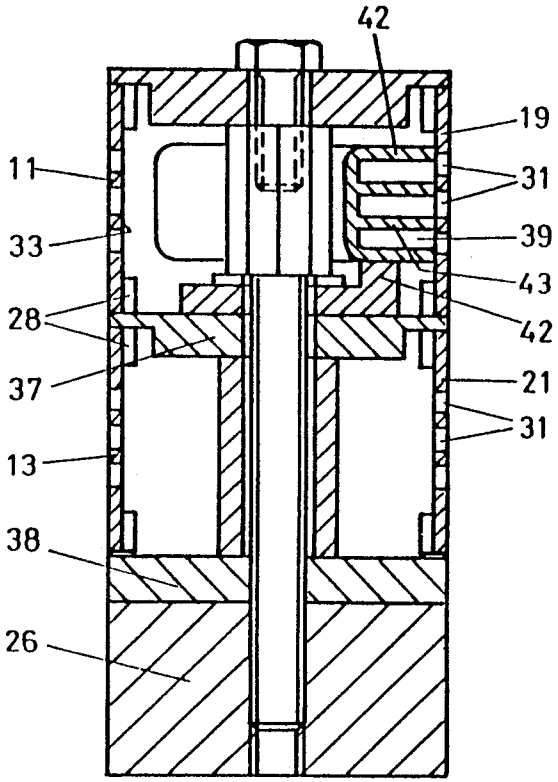
FIG. 5 is an enlarged sectional view taken along line V—V of FIG. 2.
Figure 4:
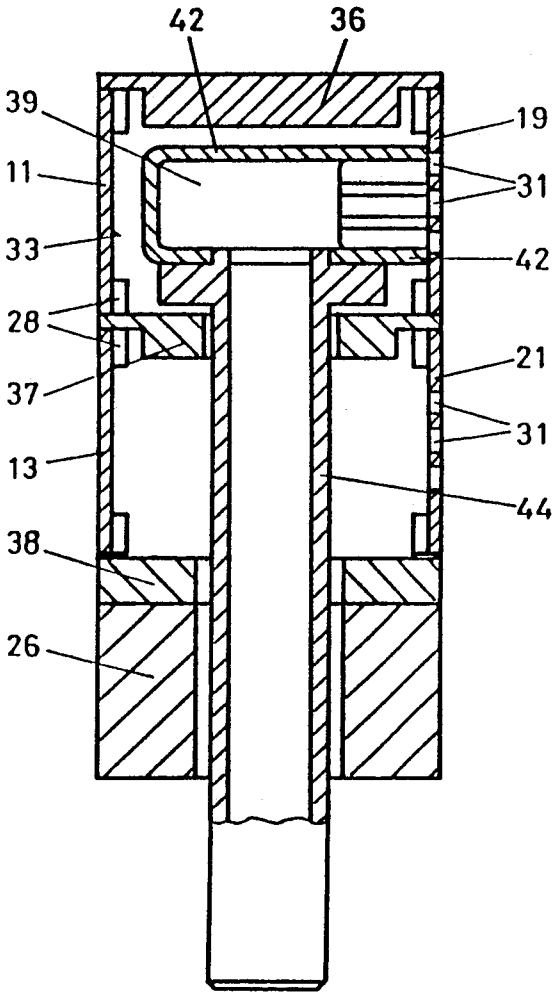
FIG. 4 is an enlarged sectional view taken along line IV—IV of FIG. 2.

Also referring to FIGS. 4 and 5, above the upper suction belts 11, 12 and bilaterally of the lower suction belts 13, 14 there are secured covers 36, 37, 38 to respective carriers 26. The covers 36–38 serve as lateral guides for the suction belts 11–14. In FIG. 2 the covers are omitted for better visibility. Between the covers 36–38 longitudinal suction channels 39, 40, 41 are provided adjacent the flights 19–22, at the toothed side 33 thereof. The longitudinal suction channels 39, 40, 41 are open towards the flights 19–22. The flights 19–22 sealingly engage the outer edge faces of the longitudinal walls 42 forming the channels 39–41. Additionally, support ribs 43 may be provided which extend parallel to the walls 41. The channels 39, 40, 41 are connected at their longitudinal middle by a pipe 44 which passes through the carriers 26 and which is coupled to a non-illustrated suction pump. Thus, as illustrated in FIG. 2, the bags 1, as they are advanced by the circulating, divergent suction belts 11–14, adhere thereto by virtue of the suction air stream and are gradually spread open.

With the short, upper belts 11, 12 there is associated a respective single suction channel 39 whereas with the long, lower belts 13, 14 there are associated two longitudinally adjoining suction channels 40, 41 which are connected each by a separate pipe 44 with the suction pump. This arrangement ensures that upon startup of the apparatus, when the leading bag 1 has first reached the beginning of the suction zone of the lower suction belts 13, 14, sufficient vacuum could build up in the channels 40 in spite of the still-uncovered openings 31 in the downstream zone.

The described opening device has a very short structural length and reliably spreads open the bags, even if they are made of a very soft, pliable material. The apparatus needs no mechanical grippers for spreading the bags open. The non-perforated zones 34 of the suction belts 11–14 have the advantage that upon suction no significant leakage is generated, and therefore the required vacuum may be obtained with a relatively small suction output. Further, the non-perforated intermediate zones 34 cause a more reliable opening of the bags 1. Were the belts 11–14 perforated throughout, in case of an only slight difference in the vacuum between the left and the right channel 39 associated with the belts 11, 12, the bags 1 would, along their entire width, adhere to the stronger vacuumized belts 11, 12 and, as a result, the bags 1 would not spread open symmetrically which would be disadvantageous for the operation of the apparatus.

Since, because of the above-discussed reasons, the belts 11–14 should have non-perforated intermediate zones 34, the belts have to move synchronously with the cutting device 7, and must not slip as they are driven synchronously by the shaft 18. Such slippage is prevented by designing the belts 11–14 as sprocket belts.

For advancing the bags 1, pairs 48 of mandrels 49 are mounted on an endless, circulating, non-illustrated conveyor chain which has the same circumferential speed as the belts 11–14. The mandrel pairs 48 are lowered into the spread-open bags by means of non-illustrated cam tracks from an elevated end position in the zone of the downstream ends of the belts 11, 12 to assume a lower end position ahead of the downstream end of the belts 13 and 14. At the same time, the mandrels 49 of the mandrel pairs 48 are moved away (spread) from one another by means not shown. A gripper 50 travels with each mandrel pair 49 and, ahead of the end rollers 17, snaps against one of the mandrels 48. In the lower end position of each mandrel pair 48 the respective gripper 50 is situated above the cover 37 but below the longitudinal edge 4 of the bag 1. The gripper 50 thus clamps the upper bag edge between itself and the associated mandrel 49. In this manner the bag 1 is held spread open before leaving the belts 13, 14. The mandrels 49 do not need to open to such an extent that they fully open the bags 1. This ensures that in a subsequent operation the bags 1 may be easily inserted by the mandrels 49, for example, into a respective cardboard box and thereafter filled with material and sealed.

To ensure that the gripper 50 gains access to the edge of the bag 1 before the bag is released by the belts 11–14, the end rollers 17 are situated significantly downstream of the end rollers 16.

Preferably, the groups 30 of the apertures 31 are, as viewed in the longitudinal direction of the belts 11–14, approximately as wide as the mandrels 49. This ensures that the bags 1 are opened optimally for receiving the mandrels 49. In case the apparatus is to be set for narrow bag configurations and for this purpose narrow mandrels 49 are used, it is expedient to obturate the outermost row of apertures 31, for example, with a silicone sealing mass. This also ensures that, in addition to reducing the suction output, the bags 1 are reliably symmetrically opened. In the alternative, the entire belts 11–14 may be replaced by belts having non-perforated intermediate zones 34 of a different length.

It will be understood that the above description of the present invention is susceptible to various modifications, changes and adaptations, and the same are intended to be comprehended within the meaning and range of equivalents of the appended claims.

What is claimed is:

1. An apparatus for spreading open flattened bags having an open side while the bags are advanced in a conveying direction, comprising (a) a first air-pervious endless belt having a working flight provided with a working face and an opposite, reverse face;

(b) first end rollers supporting the first belt;

(c) a second air-pervious endless belt having a working flight provided with a working face and an opposite, reverse face; said working flights of the first and second belts being oriented towards one another and being divergent at an acute angle in the conveying direction;

(d) second end rollers supporting said second belt;

(e) means for driving said first and second belts for effecting a travel of the working flights thereof in the conveying direction;

(f) feeding means for sequentially advancing the bags to a common upstream end of the first and second belts, as viewed in the conveying direction;

(g) suction means for generating a vacuum for urging a gas to flow across the working flights in a direction from the working face to the reverse face of each working flight, whereby each bag introduced by said feeding means between the working flights at said upstream end adheres, with opposite bag panels, to the working faces of the working flights and is forwarded thereby in the conveying direction, while being gradually spread open;

(h) a third air-pervious endless belt having a working flight provided with a working face and an opposite, reverse face; said working flight of said third belt adjoining the working flight of said first endless belt in a flush, parallel relationship therewith; said working flight of said third belt extending from said upstream end beyond a downstream end of said first belt;

(i) third end rollers supporting said third belt;

(j) a fourth air-pervious endless belt having a working flight provided with a working face and an opposite, reverse face; said working flight of said fourth belt adjoining the working flight of said second belt in a flush, parallel relationship therewith; said working flight of said fourth belt extending from said upstream end beyond a downstream end of said second belt; said working flights of said third and fourth belts being oriented towards one another;

(k) fourth end rollers supporting said fourth belt; and (l) additional suction means for generating a vacuum for urging a gas to flow across the working flights of said third and fourth belts in a direction from the working face to the reverse face of the working flight of the third and fourth belts.

2. An apparatus as defined in claim 1, further comprising means for altering said acute angle.

3. An apparatus as defined in claim 1, wherein said acute angle is 5° at the most.

4. An apparatus as defined in claim 1, wherein each belt has opposite marginal zones extending along a length of the belt; each said belt being a toothed belt having teeth provided only in at least one of the marginal zones.

5. An apparatus as defined in claim 4, wherein said belts are rendered air-pervious by a plurality of apertures formed in the belts and distributed along the length thereof; said apertures forming a plurality of aperture groups spaced uniformly from one another.

6. An apparatus as defined in claim 1, further comprising cover members extending along opposite longitudinal edges of each said belt$for a lateral guidance thereof.

7. An apparatus as defined in claim 1, wherein said suction means comprises means for defining channels stationarily supported adjacent said reverse face of the working flight of each said belt; each channel having side walls being in a sealing contact with respective said reverse faces.

8. An apparatus as defined in claim 7, wherein the channels are divided into adjoining chambers along the working flights; said suction means further comprising a suction source separately connected to each said chamber.

9. An apparatus for spreading open flattened bags having an open side while the bags are advanced in a conveying direction, comprising (a) a first air-pervious endless belt having a working flight provided with a working face and an opposite, reverse face;

(b) first end rollers supporting the first belt;

(c) a second air-pervious endless belt having a working flight provided with a working face and an opposite, reverse face; said working flights of the first and second belts being oriented towards one another and being divergent at an acute angle in the conveying direction;

(d) second end rollers supporting said second belt;

(e) means for driving said first and second belts for effecting a travel of the working flights thereof in the conveying direction;

(f) feeding means for sequentially advancing the bags to a common upstream end of the first and second belts, as viewed in the conveying direction;

(g) suction means for generating a vacuum for urging a gas to flow across the working flights in a direction from the working face to the reverse face of each working flight, whereby each bag introduced by said feeding means between the working flights at said upstream end adheres, with opposite bag panels, to the working faces of the working flights and is forwarded thereby in the conveying direction, while being gradually spread open; and (h) means for shifting said first and second belts as a unit in a direction perpendicular to the conveying direction.

10. An apparatus as defined in claim 9, further comprising means for altering said acute angle.

11. An apparatus as defined in claim 9, wherein said acute angle is 5° at the most.

12. An apparatus as defined in claim 9, wherein each belt has opposite marginal zones extending along a length of the belt; each said belt being a toothed belt having teeth provided only in at least one of the marginal zones.

13. An apparatus as defined in claim 12, wherein said belts are rendered air-pervious by a plurality of apertures formed in the belts and distributed along the length thereof; said apertures forming a plurality of aperture groups spaced uniformly from one another.

14. An apparatus as defined in claim 9, further comprising cover members extending along opposite longitudinal edges of each said belt for a lateral guidance thereof.

15. An apparatus as defined in claim 9, wherein said suction means comprises means for defining channels stationarily supported adjacent said reverse face of the working flight of each said belt; each channel having side walls being in a sealing contact with respective said reverse faces.

16. An apparatus as defined in claim 15, wherein the channels are divided into adjoining chambers along the working flights; said suction means further comprising a suction source separately connected to each said chamber.

* * * * *